United States Patent [19]

Dring

[11] 4,068,894

[45] Jan. 17, 1978

[54] MINING MACHINE COWL ASSEMBLY

[75] Inventor: Eric Dring, Mansfield, England

[73] Assignee: Dale (Mansfield) Limited, Mansfield, England

[21] Appl. No.: 729,897

[22] Filed: Oct. 6, 1976

[30] Foreign Application Priority Data

Mar. 26, 1976 United Kingdom ..... 12316/76

[51] Int. Cl.[2] ..... E21C 35/20

[52] U.S. Cl. ..... 299/45

[58] Field of Search ..... 299/43–45, 299/67; 30/382, 390, 391; 83/860

[56] References Cited

U.S. PATENT DOCUMENTS

| | | | |
|---|---|---|---|
| 3,161,439 | 12/1964 | Newton et al. | 299/67 |
| 3,482,879 | 12/1969 | Droste et al. | 299/45 |

FOREIGN PATENT DOCUMENTS

| | | | |
|---|---|---|---|
| 2,036,069 | 3/1977 | Germany | 299/45 |

*Primary Examiner*—Ernest R. Purser
*Attorney, Agent, or Firm*—Marshall & Yeasting

[57] ABSTRACT

A cowl assembly for use in association with the shearing drum of a mining machine has an arcuate cowl member and a cowl arm connected to the cowl member, the cowl arm having an annular mounting member at the end thereof remote from said cowl member to enable mounting of the cowl assembly in association with the shearing drum for angular movement about the axis of the drum, a plurality of peg members being arranged circumferentially on said mounting member and projecting therefrom for engagement with a sprocket wheel forming part of a power drive mechanism adapted to be supported on the mining machine. The mounting member is preferably formed in arcuate halves interconnected by bolts disposed substantially tangentially to the mounting member and at diametrically opposite locations.

4 Claims, 4 Drawing Figures

20
24A
26
25
-21-
23
25
26
24A
11
16
22
15
7
24B
24B
27
15
12

MINING MACHINE COWL ASSEMBLY

The invention relates to mining machinery and is particularly concerned with cowl assemblies for use in association with shearing drums of mining machines.

One form of machine for use in the mining of coal and other minerals (referred to hereinafter simply as "coal") incorporates a rotary shearing drum having a spiral periphery fitted with picks which during rotation of the drum break down and collect coal from the face. The spiral construction of the drum periphery is designed to discharge the coal in a direction away from the coal face on to a conveyor which extends parallel to the face. In practice however some coal is discharged to the rear of the shearing drum and accumulates on the mine floor. This accumulated coal prevents inward movement of the machine when it is desired to cut a new coal face.

In order to prevent discharge of coal to the rear of the shearing drum resort has been had to the provision of a cowl arrangement which is of arcuate configuration and serves to enclose the rear periphery of the drum. Since the drum moves in opposite directions during alternate tranverses along the coal face it is necessary to provide for movement of the cowl from one side of the drum to the other and for this purpose the cowl is generally mounted on a cowl arm pivoted about an axis coaxial with the drum axis. In practice great difficulty is encountered in moving the cowl, which is extremely heavy, between its two positions and hitherto this has generally been done manually and is a dangerous and time-consuming operation.

It is an object of the present invention to obviate or mitigate this disadvantage.

According to one aspect of the invention there is provided a cowl assembly for use in association with the shearing drum of a mining machine, the cowl assembly comprising an arcuate cowl member and a cowl arm connected to the cowl member, the cowl arm having an annular mounting member at the end thereof remote from said cowl member to enable mounting of the cowl assembly in association with the shearing drum for angular movement about the axis of the drum, a plurality of peg members being arranged circumferentially on said mounting member and projecting therefrom for engagement with a sprocket wheel forming part of a power drive mechanism adapted to be supported on the mining machine.

According to a further aspect of the invention there is provided a cowl assembly for use in association with the shearing drum of a mining machine, the cowl assembly comprising an arcuate cowl member and a cowl arm connected to the cowl member, the cowl arm having an annular mounting member at the end thereof remote from the cowl member to enable mounting of the cowl assembly in association with the shearing drum for angular movement about the axis of the drum, said mounting member being formed in arcuate halves interconnected by bolts disposed substantially tangentially to the mounting member and at diametrically opposite locations.

Preferably the two aspects of the invention referred to above are utilized in combination, said annular mounting member comprising arcuate halves interconnected by tangential bolts and said peg members being provided on the two halves of the mounting member.

In use the annular mounting member will generally be clamped around a suitable cylindrical portion of the machine. Certain types of commercially available machines however have no suitable cylindrical portion around which the support ring may be engaged but are provided with a cylindrical groove at a convenient location. The cowl assembly may be adapted for fitting to machines of this kind by the provision of a clamping member consisting of a split ring assembly comprising co-operating annular parts which may be clamped around a keying ring formed in arcuate halves so as to retain same in engagement with said annular groove, one part of said split ring assembly being provided with an external peripheral groove adapted to accommodate the annular mounting member of said cowl arm.

Embodiments of the invention will now be described, by way of example only, with reference to the accompanying drawings, in which.

Figure 1:
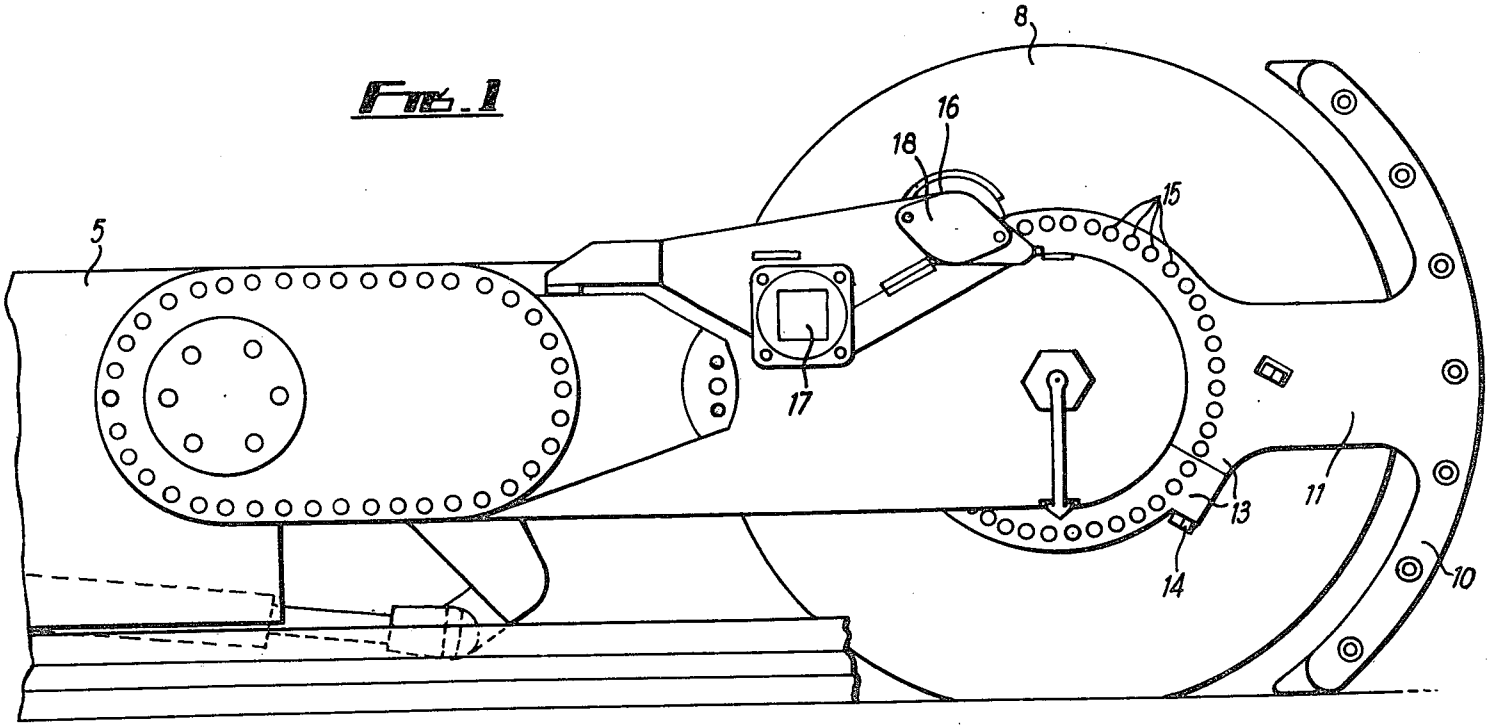
FIG. 1 is a fragmentary side elevation of a coal mining machine incorporating a shearing drum fitted with a cowl assembly according to the invention.
Figure 2:
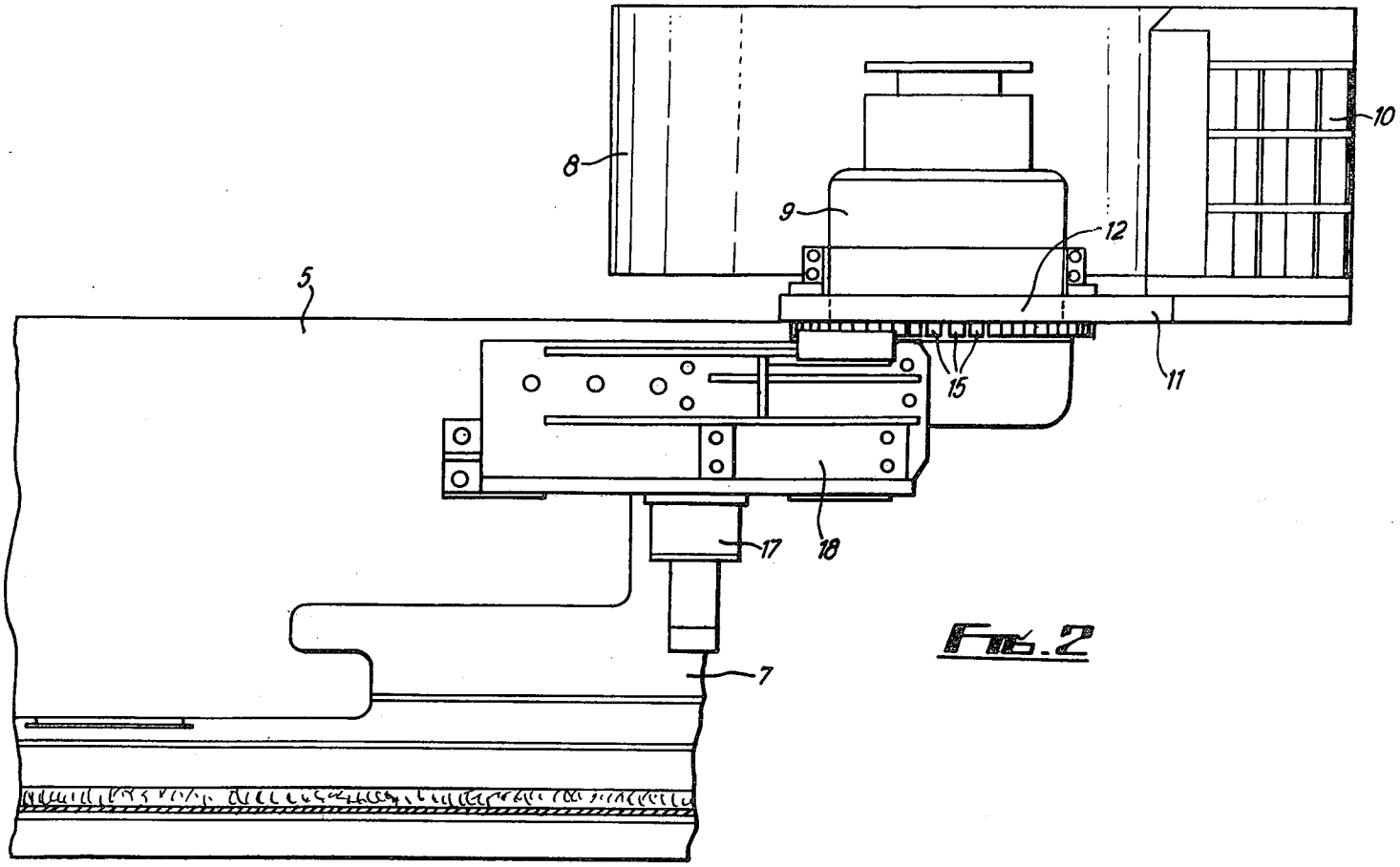
FIG. 2 is a plan view of the arrangement shown in FIG. 1.
Figure 3:
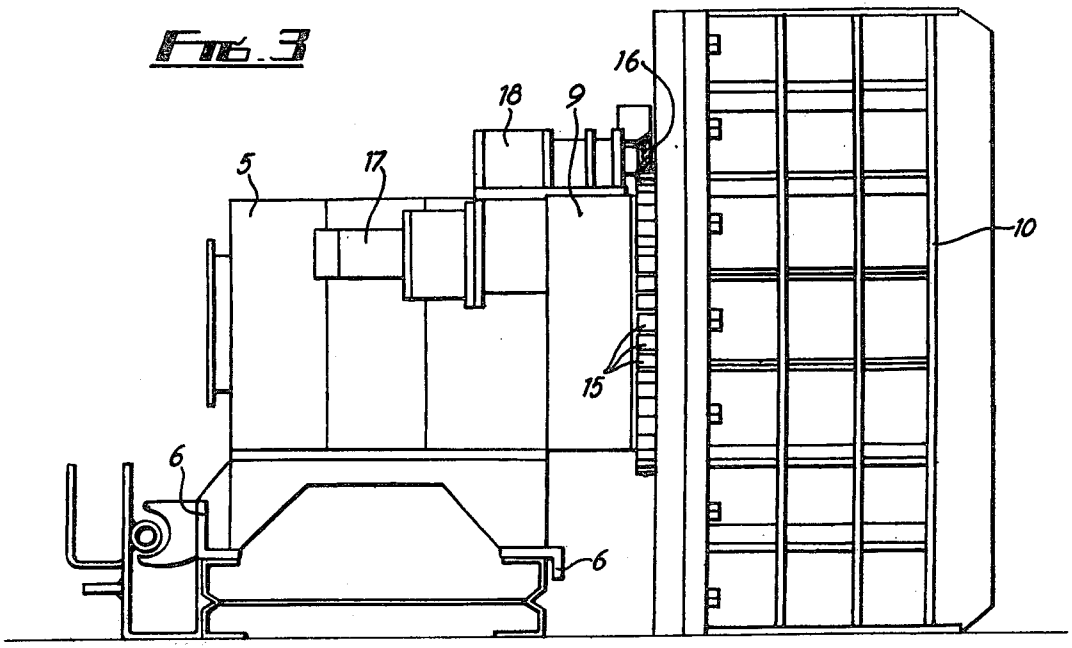
FIG. 3 is an end view.

Referring to FIGS. 1 to 3 there is shown a coal mining machine the main body of which is indicated at 5 and which is arranged to traverse backwards and forwards along a coal face on rails 6 mounted on a conveyor 7 extending parallel to the face. The machine incorporates a shearing drum 8 mounted for rotation about a horizontal axis by means of a hydraulic motor and gearbox assembly 9. The surface of the shearing drum is fitted with picks or like tools (not shown) which are arranged on helical supports such that coal removed from the face during rotation of the drum is directed outwardly away from the face and discharged on to the conveyor 7.

In order to prevent discharge of coal to the rear of the shearing drum 8 a cowl assembly is provided comprising an arcuate cowl member or blade 10 supported on a cowl arm 11 the end of which remote from the cowl member is in the form of an annular mounting ring 12. The ring 12 is in two arcuate halves the co-operating ends of which are provided with sockets 13 through which securing bolts 14 extend so that the bolts are disposed generally tangentially to the ring at diametrically opposite locations and clamp the two halves of the ring together. The mounting ring is supported on a cylindrical bearing surface on the motor and gearbox assembly.

By virtue of this construction the cowl assembly may be readily removed from the shearing drum for repair or replacement by simply releasing the bolts 14 and withdrawing the two parts of the mounting ring from the motor and gearbox assembly. This operation may be effected without requiring detachment of the shearing drum itself and without interference with the drive arrangement for moving the cowl assembly between its alternative working positions which is now to be described.

After the machine has completed one full traverse of the coal face it is moved into a rebate formed at the end of the face and is then traversed in the opposite direction to remove coal from the new face thus formed. It is therefore necessary to move the cowl assembly through approximately 180° to the opposite side of the shearing drum. For this purpose a series of pins 15 project from the outer face of the mounting ring and constitute teeth which are engaged by a sprocket wheel 16 adapted to be driven from a hydraulic motor 17 through a gearbox 18. The gearbox gears down the drive from the motor 17 so that by operation of the latter the cowl assembly may be moved in a relatively slow and controlled manner through 180° about the axis of the shearing drum preparatory to movement of the machine along the coal face in the opposite direction.

By virtue of the provision of the projecting pins 15 on the mounting ring itself the sprocket wheel 16 is located closely adjacent to the mounting ring and the power drive for the cowl assembly does not substantially increase the overall height of the body of the machine. Moreover the drive arrangement is disposed well clear of the arc of movement of the cowl member so that it cannot be fouled by the cowl member in the event of the latter being distorted. The pins 15 may also be driven out and replaced individually in the event of damage without requiring dismantling of the cowl assembly or of the drive arrangement.

Figure 4:
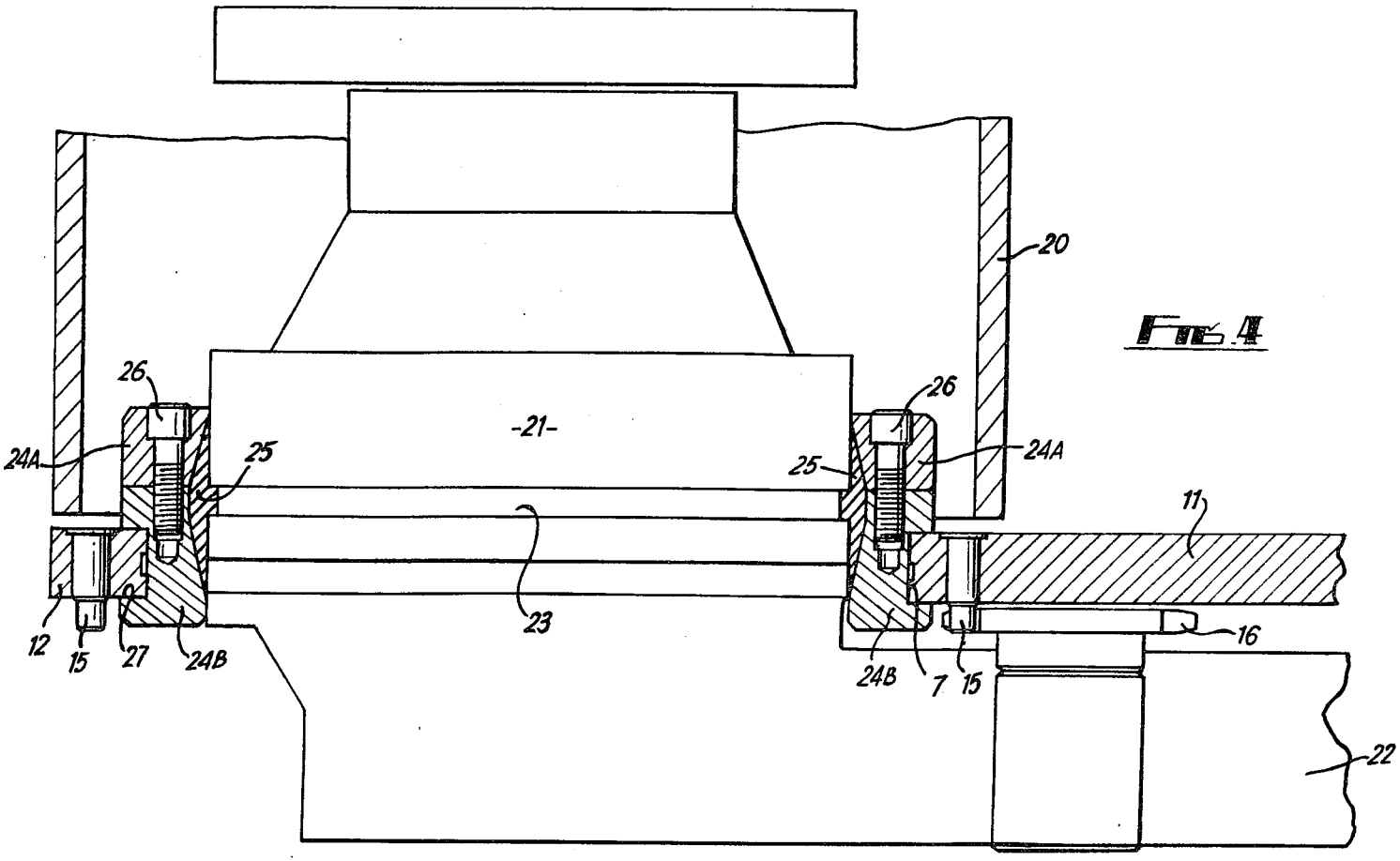
FIG. 4 is a fragmentary plan view, partly in section, showing an alternative embodiment.

FIG. 4 shows a modification of the invention for fitting to a form of commercially available coal mining machine which is not equipped with a suitable cylindrical support surface on which the mounting ring 12 can be located. In FIG. 4 the shearing drum of the machine is indicated as 20 and is driven from a gearbox 21 carried by a drive housing 22 connected to the body of the machine. The gearbox is provided with an annular groove 23 and this groove is utilised to support the cowl assembly. For this purpose a split collar consisting of annular parts 24A and 24B is fitted around the gearbox 23 and a keying ring 25 consisting of two arcuate halves is engaged with the groove 23 and has oppositely tapered outer faces engaging with complementary faces on the split ring parts 24A, 24B such that when these are secured together by bolts 26 the keying ring anchors the split ring to the gearbox 23.

The outer part 24A of the split ring, that is to say the part disposed remote from the shearing drum, is provided with a peripheral groove or channel 27 in which the mounting ring 12 of the cowl assembly is rotatably located. The mounting ring is formed in arcuate halves secured together by tangential bolts in the manner previously described and is provided with a circumferential series of pins 15 engaged by a sprocket wheel 16 to enable movement of the cowl assembly between its two positions of use as described above.

It should be appreciated that in some circumstances it may be desired to move the cowl assembly between its two positions manually in which case the drive arrangement may be omitted. Alternatively it may be desirable in some cases to utilise the drive arrangement in association with cowl assemblies which are fitted to the machine by means other than tangentially arranged bolts. It is preferred however that both arrangements be utilised in combination since this has the combined advantages of both features and the additional benefit that the width of the mounting ring and drive arrangement in a direction normal to the coal face is very small. This is significant in so far as in most commercial mining installations the overall width of the machine and the shearing drum is limited by law and any increase in width of the machine body or the cowl supporting and driving arrangement must result in a reduction in width of the shearing drum. Each inch of width of the shearing drum realises, in most commercial operation, approximately twenty tons of coal per traverse of the machine and hence by utilising the combined support and drive arrangement described above a substantial benefit in terms of coal output can be achieved.

It should be appreciated that while reference has been made herein primarily to the mining of coal the invention is equally applicable to the mining of other minerals using machines incorporating rotary shearing drums.

I claim:

1. A cowl assembly for use in association with the shearing drum of a mining machine, the cowl assembly comprising an arcuate cowl member and a cowl arm connected to the cowl member, the cowl arm having an annular mounting member at the end thereof remote from said cowl member to enable mounting of the cowl assembly in association with the shearing drum for angular movement about the axis of the drum, a power drive mechanism adapted to be supported on the mining machine and including a sprocket wheel, and a plurality of peg members arranged circumferentially on said mounting member, said peg members being cantilevered from said mounting member and being spaced from each other and from all other components of the machine with the exception of said sprocket wheel which directly engages some of said peg members.

2. A cowl assembly as claimed in claim 1, wherein the axis of each of said peg members is parallel to the axis of the shearing drum.

3. A cowl assembly according to claim 1, in which said annular mounting member is rotatably supported in a channel formed in one part of a two part split ring assembly adapted for locking engagement with a peripheral recess forming part of the mining machine.

4. A cowl assembly according to claim 3, wherein the parts of the said split ring assembly are provided with oppositely directly co-operating chamfered faces for engagement with a keying ring comprising arcuate halves having chamfered faces complementary with the faces on the parts of said split ring and an inwardly directed peripheral key for engagement with said recesses in the machine.

* * * * *